US006933666B2

(12) United States Patent
Kunitomo et al.

(10) Patent No.: US 6,933,666 B2
(45) Date of Patent: Aug. 23, 2005

(54) GLASS PANEL FOR COLOR TELEVISION PICTURE TUBE

(75) Inventors: Kazunobu Kunitomo, Otsu (JP); Tadasuke Teraoka, Otsu (JP)

(73) Assignee: Nippon Electric Glass Co., Ltd., Shiga-Ken (JP)

( * ) Notice: Subject to any disclaimer, the term of this patent is extended or adjusted under 35 U.S.C. 154(b) by 61 days.

(21) Appl. No.: 10/121,924

(22) Filed: Apr. 11, 2002

(65) Prior Publication Data

US 2002/0171349 A1 Nov. 21, 2002

(30) Foreign Application Priority Data

Apr. 11, 2001 (JP) ..... 2001-112837

(51) Int. Cl.[7] ..... H01J 29/02
(52) U.S. Cl. ..... 313/406; 313/402
(58) Field of Search ..... 313/402, 404, 313/406, 407

(56) References Cited

U.S. PATENT DOCUMENTS 4,804,880 A * 2/1989 Kavanagh ..... 313/406

FOREIGN PATENT DOCUMENTS

| | | |
|---|---|---|
| JP | 48-18429 | 5/1973 |
| JP | 51-108560 | 8/1976 |
| JP | 55-31235 | 2/1980 |
| JP | 55-31238 | 2/1980 |

* cited by examiner

*Primary Examiner*—Nimeshkumar D. Patel
*Assistant Examiner*—Sharlene Leurig
(74) *Attorney, Agent, or Firm*—J.C. Patents

(57) ABSTRACT

Each of the flat surfaces of the pin-seal portions is formed such that the width thereof in the second direction gradually increases as far as the portion upper than the stud pin in the direction from the side of the face portion to the side of the seal end surface, and forms the symmetrical shape about the center portion in the second direction. Namely, the flat surface is formed so as to have the substantially half ellipse shape which has the major axis in the second direction, and protrudes toward the face portion.

10 Claims, 7 Drawing Sheets

GLASS PANEL FOR COLOR TELEVISION PICTURE TUBE

BACKGROUND OF THE INVENTION

The present invention relates to a glass panel for a color television picture tube used for a television receiver and the like, and particularly relates to an improved technology for seal portions, formed on an inner wall surface of a skirt portion of the panel, for sealing stud pins for retaining a shadow mask.

As is generally known, major glass parts used for the color picture tube comprise a panel on which an image is projected, a funnel, and a neck in a tube shape with a small diameter. As shown in FIG. 7, a panel 1 comprises a substantially rectangular face portion 2 with an effective screen for showing an image, and a skirt portion 4 continuous to a periphery of the face portion 2 through a blend R portion 3. At an open end of the skirt portion 4, a seal end surface 5 is formed for being joined to a funnel.

As shown in FIG. 8, in a color television picture tube manufactured using the panel 1, the panel 1 and a funnel 6 are sealed together through flit glass 7 interposed between the seal end surface 5 of the panel 1 and a seal end surface 6*a* of the funnel 6, and a fluorescent film 8 and a metal back coating 9 are formed on an inner surface of the face portion 2 of the panel 1 while laminating them in this order. A shadow mask 10 is provided inside the panel 1, and multiple metal stud pins 12 are sealed and embedded in an inner wall surface 11 of the skirt portion 4 of the panel 1. The stud pins 12 and support springs 13 engaged with the stud pins 12 support the shadow mask 10 inside the color television picture tube.

In this type of a shadow mask color television picture tube, an electron gun provided inside the neck irradiates an electron beam, and the electron beam passes through holes 14 formed at a portion of the shadow mask 10 opposed to the face portion 2 after being directed by a deflecting yoke. The passing electron beam is properly irradiated on the fluorescent film 8 of three colors comprising R, G, and B, and as a result, an image is displayed. Thus, it is necessary that the fluorescent film 8 and the shadow mask 10 are disposed and opposed to each other at predetermined positions at a predetermined high precision for providing a proper image receiving action.

To meet this requirement, because it is necessary to seal the stud pins 12, which are jigs for retaining the shadow mask 10, vertically with respect to the axis of the picture tube at a high precision, and simultaneously to maintain the stud pins 12 and openings of the support springs 13 in a constant engaging state, extremely high reproducibility is necessary for a dimensional accuracy when the stud pins 12 are sealed on the inner wall surface 11 of the skirt portion 4 of the panel 1.

In this case, a support tool and pin seal means are used to seal the stud pins on the panel (not shown). The pin seal means is provided with a ceramic holder portion and ground coil portion. The ceramic holder portion approaches to and departs from the inner wall surface of the skirt portion of the panel while holding the stud pin to insert the stud pin. The ground coil portion is used to heat the stud pin held by the holder portion with high frequency energy. As a specific procedure for the sealing, a mold is used to press-form a panel into a desired shape in a molding process for the panel glass, and the support tool is used to hold the panel on a predetermined table immediately after the panel is cooled down and solidified to about 400° C. to 450° C. Then, the ceramic holder portion inserts the stud pin heated up to 1100° C. to 1250° C. by the ground coil portion of the pin seal means into the inner wall surface of the skirt portion of the panel. After this, the panel transferred form the pin seal means is transported to a lehr, to anneal the pin-seal portions along with the panel.

Because the inside of the color television picture tube is in a high vacuum state, a pressure resistance for resisting the vacuum is necessary for the panel 1. However, because this type of the color television picture tube has a complicated shape formed by joining a funnel to a panel having a rectangular face portion, its vacuum stress distribution is consequently complicated.

Specifically, because the highest vacuum tensile stress is generated on a connection portion between the peripheral of the face portion 2 to the skirt portion 4 through the blend R portion 3 of the panel 1, a neighborhood of the blend R portion 3 of the skirt portion 4 is formed thick for withstanding the high stress. On the other hand, because the vacuum tensile stress relatively lower than that on the panel 1 is applied on the funnel 6 so that the funnel 6 is relatively formed thin, the thickness of the seal end surface 5 of the panel 1, which is joined to the seal end surface 6*a* of the funnel 6 without generating a step, is thinner than the thickness of the neighborhood of the blend R portion 3 of the skirt portion 4.

This causes such a thickness distribution at the skirt portion of the panel 1 that the thickness gradually decreases from the neighborhood of blend R portion 3 to the seal end surface 5, and consequently, the inner wall surface 11 of the skirt portion 4 presents an inclined surface which departs from a center axis of the picture tube (a panel center axis) mare at the seal end surface 5 than at the face portion 2.

When the pin seal means is used to seal the stud pin 12 in the inner wall surface 11 of the skirt portion 4, the inclined inner wall surface 11 of the skirt portion 4 causes the following problems. Namely, because the inner wall surface 11 is inclined, it is extremely difficult to evenly form a glass buildup all around the stud pin 12 for forming a pin-seal portion with high strength while the stud pin 12 with the diameter of 10 mm to 15 mm is maintained in an attitude vertical to the panel center axis. This causes a generation of a crack due to a defective seal such as an inclination of the stud pin 12 after sealing, and consequently a breakage of the glass panel, and because the stud pins 12 are not accurately sealed vertically with respect to the panel center axis, it is also difficult to retain the shadow mask highly accurately.

To meet these problems, flat surfaces 15 are formed on the inner wall surface 11 as a conventional measure. The flat surfaces 15 are substantially parallel with a first direction (a direction a—a in FIG. 7) along the panel center axis X, and substantially parallel with a second direction (a direction b—b in FIG. 7) along a line across two corners 4R neighboring to each other of the skirt portion 4. However, there is no consideration given to not only an outer peripheral shape of a pin-seal portion 16 having the flat surface 15 seen from the opposing inner wall surface 11, but also to a recess and protrusion shape of the pin-seal portion 16 seen from the seal end surface. As a result, conventionally, the outer peripheral shape of the flat surface 15 is merely formed as substantially rectangular as shown in FIG. 9(*a*), and inclined portions 16*a* rising sharply are formed at an outer periphery in the second direction of the flat surface 15 as shown in FIG. 9(*b*) so that the flat surface 15 merely protrudes toward the opposing inner wall surface 11.

As a result, corners of the flat surface 15, especially corners 16*x* on the side of the face portion 2 are not obtuse angle corners, but substantially right angle corners, and the sharply rising inclined portions 16*a* between the outer periphery in the second direction of the corners 16*x* and the inner wall surface 11, in other words, steps gradually rising toward the seal end surface 5, exist.

In this case, when the glass panel having flat surfaces 15 in the shape described above is molded, mold surface portions in substantially rectangular recess shapes corresponding to shapes of the pin-seal portions 16 are formed on a plunger (a male mold), a molten glass mass called as glass gob is supplied for a bottom mold to which a shell mold is attached, in this state, the plunger is pressed against the gob to apply a pressure, thereby the molten glass flows up from the face portion to the skirt portion through the blend R portion.

When the corners 16*x* of the flat surface 15 on the side of the face portion 2 are substantially right angle, and there are the steps between the corners 16*x* and the inner wall surface 11, because the corners 16*x* inhibit a smooth flow of the molten glass when the molten glass rises up to the skirt portion, and there exist the large local thickness changes, the temperature of the plunger largely differs between at portions corresponding to the flat surfaces and at a portion corresponding to the inner wall surface. This generates defective molding such as wrinkles, and small recesses and protrusions around the flat surfaces of the molded glass panel, especially around the corners 16*x* on the side of the face portion 2, and this not only decreases the commodity value, but also causes the decrease of the yield.

SUMMARY OF THE INVENTION

An object of the present invention is to improve the pin-seal portions for stud pins on the inner wall surface of the skirt portion of the panel, to smooth the flow of the molten glass around the pin-seal portions when the panel is molded, and to prevent the generation of a defective panel molding.

To attain the object above, the present invention provides a glass panel for a color television picture tube comprising a substantially rectangular face portion provided with an effective screen, a skirt portion continuing to a periphery of the face portion through a blend R portion, a seal end surface formed on an open end of the skirt portion, pin-seal portions for stud pins for retaining a shadow mask, formed on an inner wall surface of the skirt portion, wherein flat surfaces are formed at the pin-seal portions, each of the flat surfaces being substantially parallel with a first direction along a panel center axis and substantially parallel with a second direction along a line across two neighboring corners of the skirt portion, a width of which in the second direction gradually increases in a direction from the face portion to the seal end surface as far as at least an end of the stud pin at the side of the face portion.

In this case, because the width in the second direction of the flat surface gradually increases in the direction from the face portion to the seal end surface as far as at least the end of the stud pin at the side of the face portion, the outer periphery of the flat surface at the side of the face portion has a shape close to a partial arc, a partial ellipse, an apex angle part of a triangle, a shorter base part of a trapezoid, or a high order curve such as a second order curve and a fourth order curve.

Thus, there exist no substantially right angle corners at the side of the face portion of the flat surfaces as in the conventional example, the case where the corners prevent the flow of the molten glass when the molten glass flows up to the seal end surface of the skirt portion does not occur, the flow becomes smooth around the flat surfaces, and defective molding such as wrinkles is prevented from occurring.

Also because the defective molding hardly occurs, it is possible to delay timing for applying a mold release agent on the mold for reducing the application work of the mold release agent, and the amount of the applied mold release agent.

In this case, it is preferable that the outer periphery of the flat surface is separated from an outer peripheral surface of the stud pin. Namely, for example, if a portion of the outer periphery of the flat surface coincides with, or overlaps a portion of the outer peripheral surface of the stud pin, it may be impossible to form an even buildup around the stud pin, and to precisely seal the stud pin orthogonal to the panel center axis. However, if they are separated from each other, it is possible to precisely seal the stud pin.

Further, it is preferable that the outer periphery of the flat surface is separated from the outer peripheral surface of the stud pin by 3 mm or more. With this constitution, a residual stress generated by sealing the stud pin, and a stress concentration in the buildups around the stud pin generated by the sealing are mitigated, and defects such as a breakage of the glass surface around the sealed stud pin is more surely avoided.

It is preferable to provide a slight taper such that the flat surface is departed from the panel center axis more at the side of the face portion than at the side of the seal end surface. In this case, it is necessary for the slight taper not to adversely affect the accuracy of sealing the stud pin. With this constitution, when the mold is removed after molding the panel, it is possible to avoid scratches generated on the flat surfaces of the panel.

On the other hand, it is preferable that the flat surface has a shape satisfying a relationship of $H<L$, where H is the maximum width in the first direction, and L is the maximum width in the second direction. The reason for forming this shape is as follows.

Namely, a fluorescent film is applied on an inner surface of the face portion of the panel, and slurry of fluorescent film application liquid is directly supplied as spray on the center of the inner surface of the panel while the panel held at a predetermined angle with the seal end surface facing upward or downward is turning in a process for manufacturing a color picture tube. In this case, a part of the application liquid which flows toward the periphery of the face portion due to the centrifugal force generated by the turn of the panel flows toward the pin-seal portion for the stud pin formed on the inner wall surface of the skirt portion, because the flat surface has the shape satisfying $H<L$, the application liquid flows along the periphery of the pin-seal portion, where the flat surface is formed, at the side of the face portion without scattering around the stud pin, and then is drained to the outside through the corners on the inner wall surface of the skirt portion.

In more detail, if the flat surface has the conventional substantially rectangular shape, the application liquid which flows toward the pin-seal portion, where the flat surface is formed, collides with the corners of the flat surface, scatters, and adheres to the stud pin which have already been sealed and embedded, is removed in a following process for mounting and dismounting the shadow mask as a result, and causes defects such as clogging shadow mask, and a defective emission due to a contaminated electron gun.

On the other hand, if the flat surface does not have the substantially right angle corners, and the shape of the flat surface satisfy H<L, namely the width in the direction along the line across the two neighboring corners, in other words, in a direction substantially along the periphery of the face portion, is longer than the width along the panel center axis, guide paths are formed for guiding the application liquid to the outside along the periphery of the pin-seal portion at the side of the face portion, and the application liquid flows along the guide paths while avoiding the stud pin. Thus, the problem that the fluorescent film application liquid is attached to the stud pin during applying the fluorescent film is effectively avoided.

It is more preferable that relationships H/R>1.5 and L/R>3 are satisfied, where H is the maximum width in the first direction of the flat surface, L is the maximum width in the second direction of the flat surface, and R is the diameter of the stud pin. With this constitution, the fluorescent film application liquid is guided to the outside as above while the flow of liquid is surely separated from the stud pin. In this case, if H/R is 1.5 or less, it is difficult to form the even glass buildup around the stud pin when the stud pin is sealed, and the vertical attitude of the stud pin with respect to the panel center axis may present a deviation. If L/R is 3 or less, the flow of the fluorescent application liquid around the stud pin is not smooth, and the tendency of the scatter of the application liquid around the stud pin is promoted, or the application liquid may adhere to the stud pin.

It is preferable that the flat surfaces are formed when the panel glass is molded using a plunger having preformed mold surface portions corresponding to the pin-seal portions. In detail, mold surface portions corresponding to the flat surfaces and neighborhood shapes are formed on the plunger (a male mold), and glass gob is supplied for a bottom mold to which a shell mold is attached. Then, the plunger is pressed against the gob while a pressure is applied, thereby the molten glass rises up from the face portion to the skirt portion through the blend R portion. Thus, the pin-seal portions having the flat surfaces without wrinkles thereabout are obtained as a result of the completed rise. In this way, because the pin-seal portions are formed simultaneously with the molding of the panel, a complicated and difficult work such as independently forming the pin-seal portions in a following process is not necessary, and the workability increases.

Further, to attain the object above, the present invention provides a glass panel for a color television picture tube comprising, a substantially rectangular face portion provided with an effective screen, a skirt portion continuing to a periphery of the face portion through a blend R portion, a seal end surface formed on an open end of the skirt portion, pin-seal portions for stud pins for retaining a shadow mask, formed on an inner wall surface of the skirt portion, wherein flat surfaces are formed at the pin-seal portions, each of the flat surfaces being substantially parallel with a first direction along a panel center axis and substantially parallel with a second direction along a line across two neighboring corners of the skirt portion, and an outer periphery of each of the flat surfaces in the second direction are formed so as not to protrude more than a joint portion between outer peripheral side extensions of the outer periphery and the inner wall surface of the skirt portion toward the opposing inner wall surface of the skirt portion.

The outer peripheral side extension may be inclined portion comprising a line or a curve for gently continuing the outer periphery in the second direction of the flat surface and the inner wall surface with each other.

With this constitution, because the outer periphery in the second direction of the flat surface do not protrude toward the opposing inner wall surface of the skirt portion with respect to the joint between the outer peripheral side extensions and the inner wall surface of the skirt portion, there exist no sharply rising inclined portions at the outer periphery in the second direction of the flat surface, and consequently there exist no conventional substantially right angle corners which have sharply rising inclined portions. As a result, the corners do not prevent the flow of the molten glass rising toward the seal end surface of the skirt portion when the panel is molded, the flow is smoothed around the flat surfaces, and the generation of defective molding such as wrinkles is prevented from occurring.

Further, because thickness changes slightly between the flat surface and the inner wall surface of the skirt portion, the temperature difference between the portions of the plunger corresponding to the flat surfaces and the inner wall surface is extremely small, and there is no possibility of decreasing the separability. Thus, this also contributes to avoiding a problem of generating the defective molding such as wrinkles. Because the defective molding hardly occurs, it is possible to decrease the application work and the amount of the mold release agent.

In this case, it is preferable that the flat surface is uniformly flat from the joint portion between the outer peripheral side extensions and the inner wall surface of the skirt portion. Namely, the open end of the skirt portion of the panel has a rectangular shape, and individual side between the mutually neighboring corners slightly protrude toward a direction departing from the panel center axis at the center in the second direction, the inner wall surface of the individual side is curved surface which is recessed at the center portion in the second direction. Thus, by extending the flat surface as far as the outer periphery in the second direction reach the inner wall surface in this shape, the uniform flat surface is formed. Forming the uniform flat surface prevents a large change in the thickness in the neighborhoods of the flat surface, the generation of the defective molding is effectively avoided, and there is benefit of easily machining a mold for forming the flat surfaces on the inner wall surface.

DETAILED DESCRIPTION OF THE PREFERRED EMBODIMENTS

Figure 7:
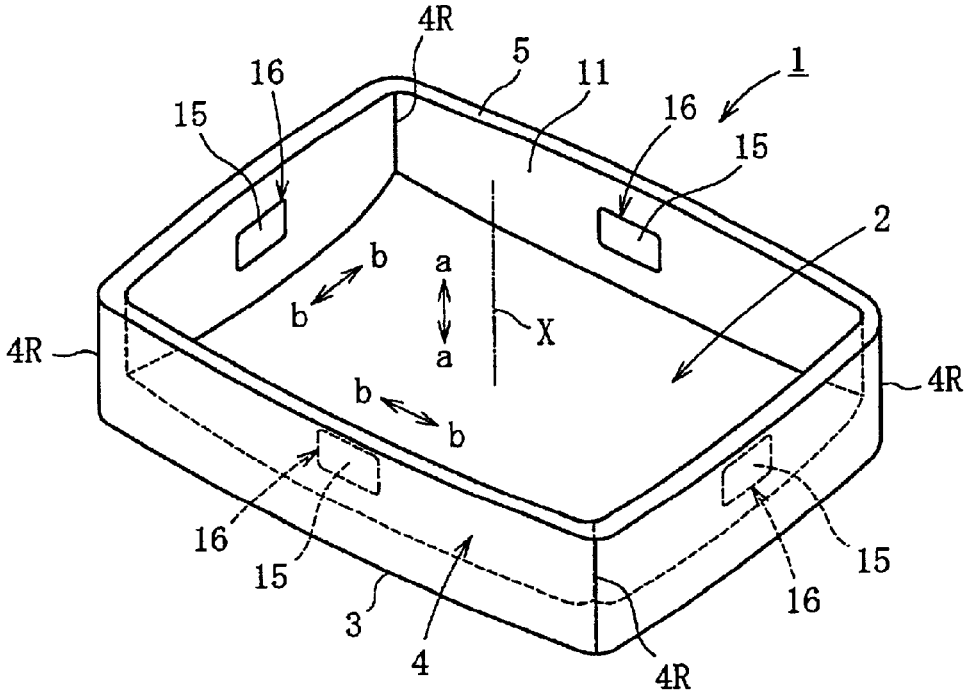
FIG. 7 (PRIOR ART)
FIG. 7 is a perspective view showing a panel of prior art.
Figure 8:
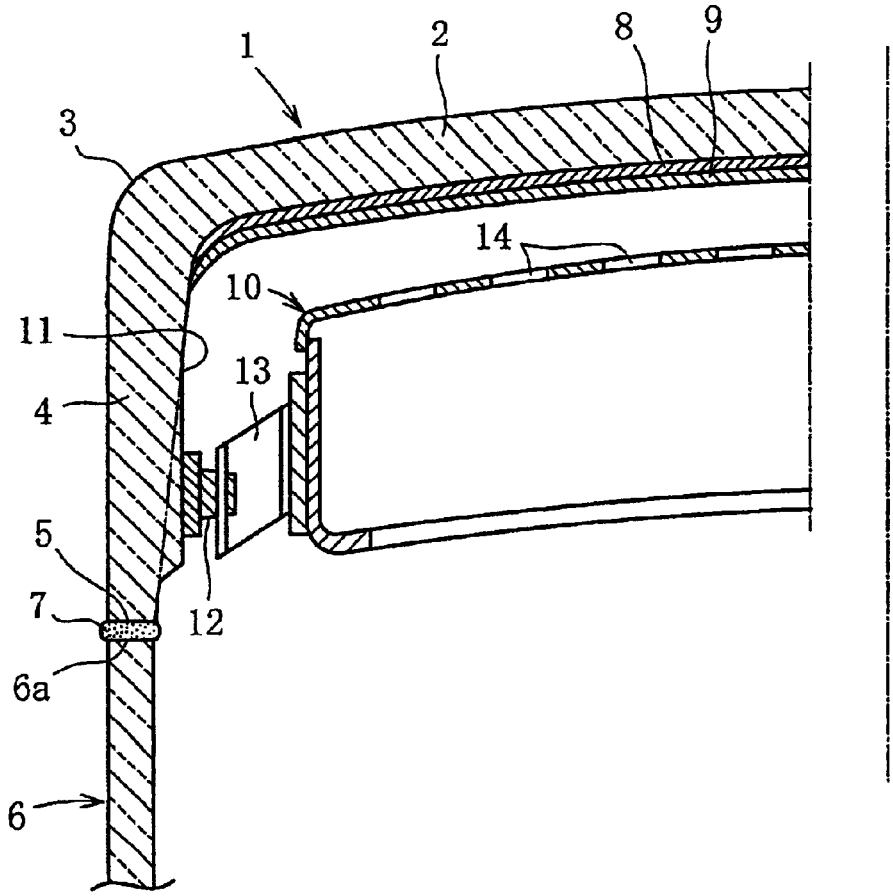
FIG. 8 (PRIOR ART)
FIG. 8 is a longitudinal sectional view showing a principal part of a panel neighborhood of prior art.
Figure 9A:
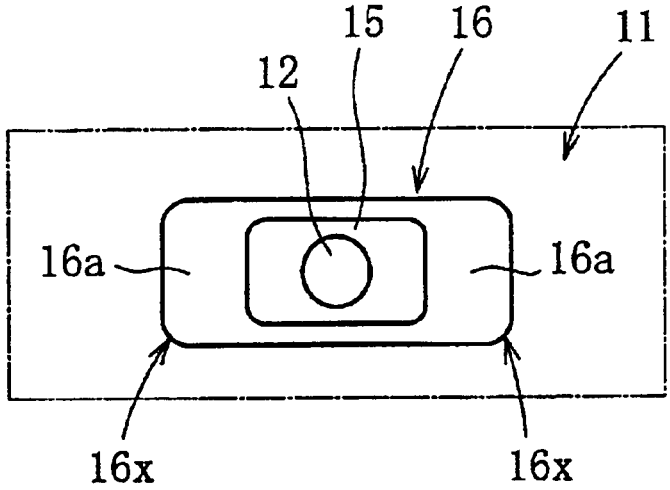
FIG. 9(a) (PRIOR ART)
FIG. 9(*a*) is a front view showing an inner wall surface of a skirt portion of a panel of prior art, and FIG. 9(*b*) is a plan view thereof.
Figure 9B:
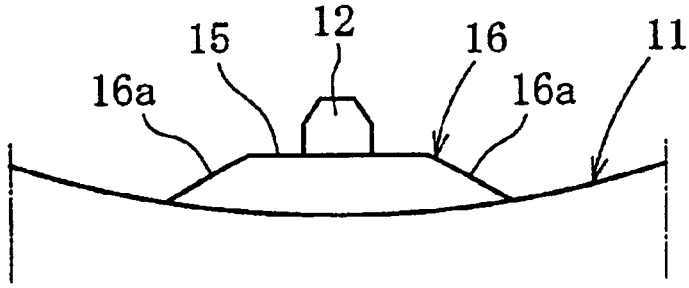
FIG. 9(b) (PRIOR ART)

Embodiments of the present invention will be described with reference to the accompanying drawings. Constituting elements common to those in the description based on FIG. 7 to FIG. 9 are given the identical numerals, and detailed description thereof is omitted in description based on FIG. 1 to FIG. 6.

Figure 1:
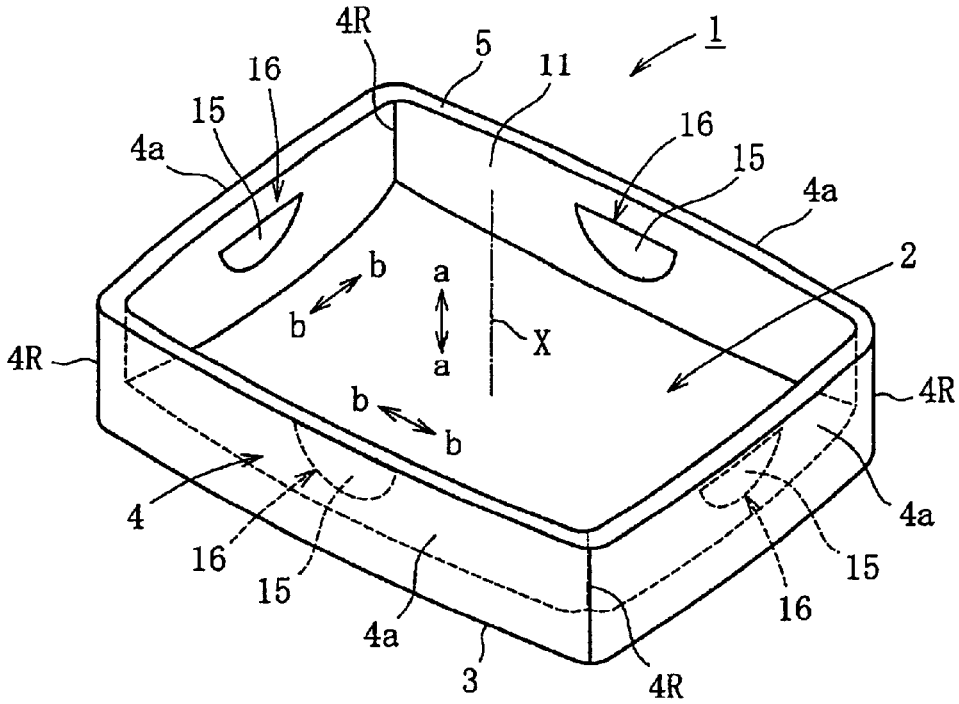
FIG. 1 is a perspective view showing a panel according to an embodiment of the present invention.

FIG. 1 is a perspective view showing a glass panel 1 (simply referred as a panel 1 hereafter) for a color picture tube according to the embodiment. As shown in the drawing, a skirt portion 4 of the panel 1 is provided with individual sides 4*a* between four corners 4R neighboring to each other, and individual pin-seal portions 16 for stud pins are formed at the substantial center portions in a second direction (a direction b—b in the drawing) of the individual sides 4*a*. Flat surfaces 15 substantially parallel with a first direction (a direction a—a in the drawing) and substantially parallel with the second direction are formed at the individual pin-seal portions 16.

Figure 2A:
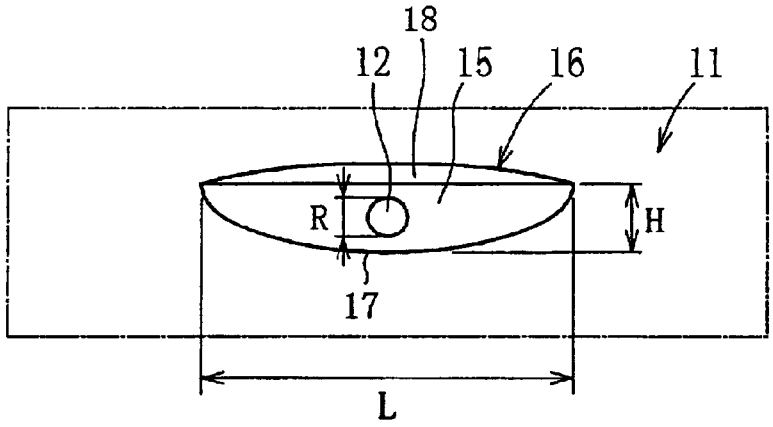
FIG. 2(*a*), FIG. 2(*b*), and FIG. 2(*c*) are front views showing inner wall surfaces of skirt portions of panels according to respective embodiments of the present invention.
Figure 2B:
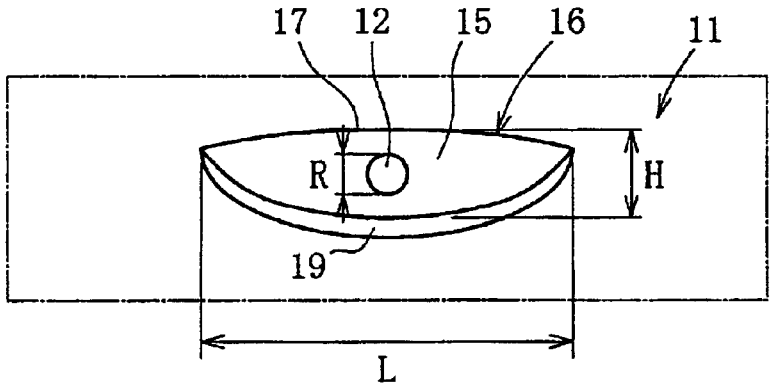
Figure 2C:
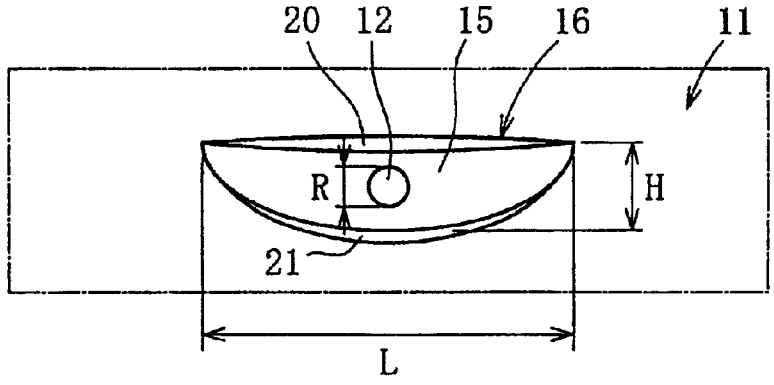
Figure 3C:
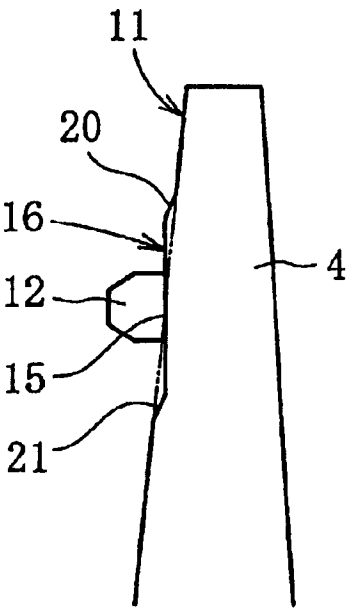
FIG. 3(*a*), FIG. 3(*b*), and FIG. 3(*c*) are longitudinal sectional views of principal parts showing the skirt portions of the panels according to the respective embodiments of the present invention.
Figure 3B:
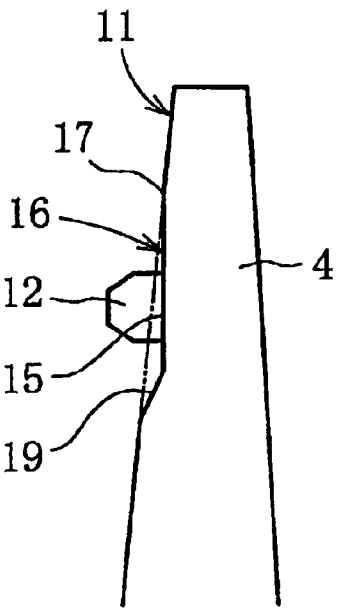
Figure 3A:
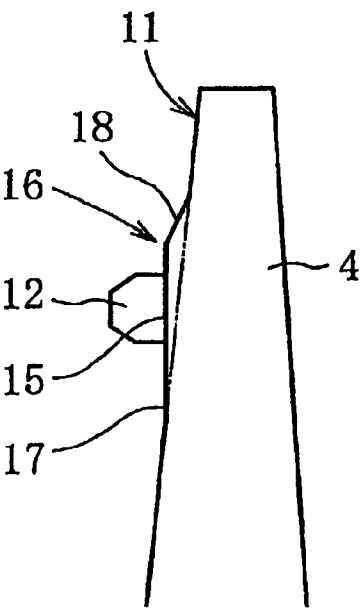

FIG. 2 is a front view of the inner wall surface 11 of the skirt portion 4, and FIG. 3 is a longitudinal sectional view of the skirt portion 4 crossing the stud pin 12. As shown in FIGS. 2(*a*), (*b*), and (*c*), the flat surface 15 of the pin-seal portion 16 is formed such that a width of the outer peripheral thereof in the second direction is gradually increases as far as an upper position than the stud pin 12 in a direction from the side of the face portion 2 (the lower side in the drawing) to the side of the seal end surface 5 (the upper side in the drawing), and the flat surface 15 has a symmetrical shape about the center portion in the second direction. Specifically, the flat surface 15 is formed as a shape close to a half ellipse protruding toward the face portion 2 having a major axis in the second direction.

The flat surface 15 has a shape satisfying a relationship of H<L, where H is the maximum width in the first direction and L is the maximum width in the second direction, and more specifically has a shape satisfying the relationships of H/R>1.5 and L/R>3 where H and L are the maximum widths, and R is the diameter of the stud pin 12. In this case, the stud pin 12 is sealed at the substantial center portion in the first direction and the substantial center portion in the second direction of the flat surface 15. In regard to the inner wall surface 11 of the skirt portion 4, the center portion thereof in the second direction curves so as to protrude toward the opposing inner wall surface 11, and the center portion thereof in the first direction also curves so as to protrude toward the opposing inner wall surface 11. The inner wall surface 11 as a whole is an inclined surface departs from the opposing inner wall surface 11 more at the side of the seal end surface 5 than at the side of the face portion 2.

As shown in FIG. 3(*a*), in the pin-seal portion 16 as a first example, while the outer periphery of the flat surface 15 at the side of the face portion 2 continues with the inner wall surface 11 at a joint portion (a joint line) 17 as a boundary, the outer periphery of the flat surface 15 at the side of the seal end surface 5 continues to the inner wall surface 11 through an inclined surface 18 with a gentle angle. In addition, as shown in FIG. 2(*a*), while the outer periphery (the joint portion 17) of the flat surface 15 at the side of the face portion 2 has the shape close to the half ellipse, the outer periphery at the side of the seal end surface 5 has a shape close to a line, in more detail, the center portion thereof in the second direction has a curved shape slightly protruding toward the seal end surface 5, and the width of the inclined surface 18 continuous therewith in the first direction is gradually decreases toward the both sides with the center portion in the second direction as the boundary to become substantially zero at neighborhoods of the outer most periphery of the flat surface 15 in the second direction.

As shown in FIG. 3(*b*), in the pin-seal portion 16 as second example of, while the outer periphery of the flat surface 15 at the side of the seal end surface 5 continues with the inner wall surface 11 at the joint portion (the joint line) 17 as a boundary, the outer periphery of the flat surface 15 at the side of the face portion 2 continues to the inner wall surface 11 through an inclined surface 19 with a gentle angle. In addition, as shown in FIG. 2(*b*), while the outer periphery of the flat surface 15 at the side of the seal end surface 5 (the joint portion 17) has a shape close to a line, in more detail, while the center portion thereof in the second direction has a curved shape slightly protruding toward the seal end surface 5, the outer periphery of the flat surface 15 at the side of the face portion 2 has the shape close to the half ellipse as described above, and the width of the inclined surface 19 continuous therewith in the first direction is gradually decreases toward the both sides with the center portion in the second direction as the boundary to become substantially zero at neighborhoods of the outer most periphery of the flat surface 15 in the second direction.

As shown in FIG. 3(*c*), in the pin-seal portion 16 as third example, the outer periphery of the flat surface 1S at the side of the seal end surface 5 continues to the inner wall surface 11 through an inclined surface 20 with a gentle angle, the outer periphery of the flat surface 15 at the side of the face portion 2 also continues to the inner wall surface 11 through an inclined surface 21 with a gentle angle. In addition, as shown in FIG. 2(*c*), while the outer periphery of the flat surface 15 at the side of the seal end surface 5 has a shape close to a line, in more detail, the center portion thereof in the second direction has a curved shape slightly protruding toward the side of the face portion 2, the outer peripheral portion of the inclined surface 20 continuous therewith at the side of the seal end surface 5 has a curved shape slightly protruding toward the seal end surface 5, and the width of the inclined surface 20 in the first direction becomes substantially zero at neighborhoods of the outer most periphery of the flat surface 15 in the second direction. On the other hand, the outer periphery of the flat surface 15 on the side of the face portion 2 has the shape close to the half ellipse as described above, and the width of the inclined surface 21 continuous therewith in the first direction is gradually decreases toward the both sides with the center portion thereof in the second direction as the boundary to become substantially zero at neighborhoods of the outer most periphery of the flat surface 15 in the second direction.

The maximum width H in the first direction is for example 20 mm to 30 mm, and more preferably about 25 mm, and the maximum width L in the second direction is for example 80 mm to 120 mm, more preferably about 100 mm, for the individual flat surfaces 15 of the pin-seal portions 16 shown as the first to third examples. The inclination angles against the panel center axis of the individual inclined surfaces 18 to 21 are 10° to 18°, and the individual inclined surfaces 18 to 21 have shapes symmetrical about the center portion in the second direction as a boundary in these examples. The stud pins 12 with the diameter of 10 mm, for example, are used. The pin-seal portion 16 shown as the third example is the most preferable of the first to third examples. With this pin-seal portion 16, the thickness change in the periphery of the flat surface 15 can be minimized so that the degradation of molding due to the step is surely avoided.

Figure 4:
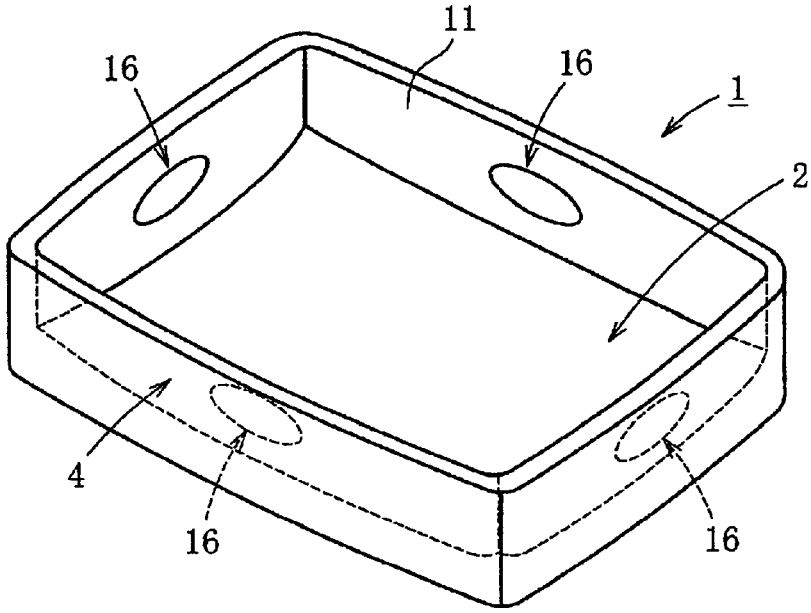
FIG. 4 is a perspective view showing a panel according to another embodiment of the present invention.

Further, as shown in FIG. 4, in the pin-seal portion 16 as fourth example, the shape of the flat surface (including inclined surface at the periphery thereof) is an ellipse having the major axis in the second direction. In this case, the way of formation of the flat surface and the inclined surface with respect to the inner wall surface 11 may be any one of FIG. 3(*a*), (*b*), and (*c*). Also, in this case, the width of the flat surface in the second direction gradually increases as far as the neighborhood of the center axis of the stud pin 12, or as far as the neighborhood of the end of the stud pin 12 at the side of the face portion, in a direction from the side of the face portion 2 to the side of the end seal surface 5.

Figure 5A:
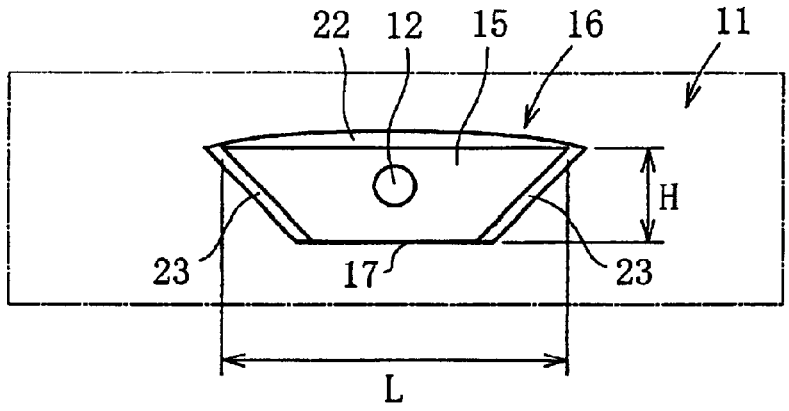
FIG. 5(*a*) is a front view showing an inner wall surface of a skirt portion of a panel according to an embodiment of the present invention, and FIG. 5(*b*) is a plan view showing the inner wall surface.
Figure 5B:
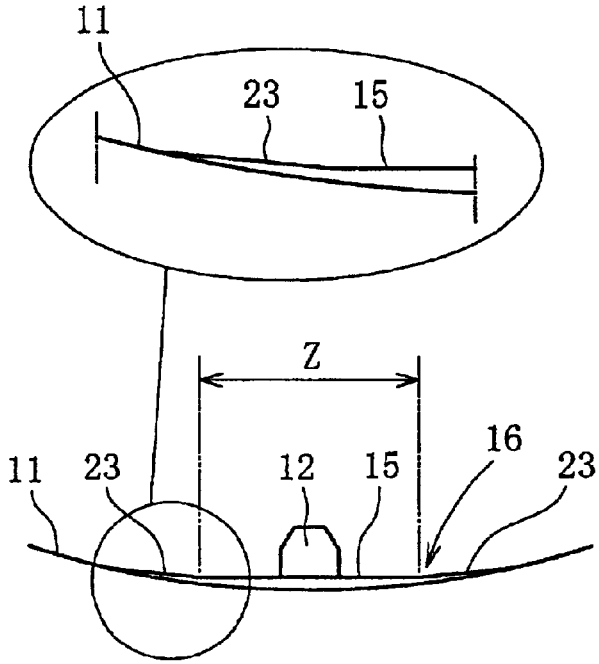

As shown in FIG. 5(*a*), in the pin-seal portion 16 as fifth example, the flat surface 15 has a shape close to a trapezoid, in more detail, the flat surface 15 has a shorter base side at the side of the face portion 2, and is close to a trapezoid symmetrical about the center portion thereof in the second direction. The longitudinal section thereof, as the shape shown in FIG. 3(*a*), is designed such that while the outer periphery of the flat surface 15 at the side of the face portion 2 continues with the inner wall surface 11 through the joint portion 17, which is the shorter base side, the outer periphery of the flat surface 15 at the side of the seal end surface 5 continues to the inner wall surface 11 through a inclined surface 22. Further, in the pin-seal portion 16, the outer periphery of the flat surface 15 (shown as a width Z) in the second direction continues to the inner wall surface 11 through outer peripheral side extensions 23 having gentle inclined surfaces as shown in a plan view in FIG. 5(*b*). The outer periphery of the flat surface 15 in the second direction is formed so as not to protrude toward the opposing inner wall surface 11 with respect to the joint portion 17 between the outer peripheral side extensions 23 and the inner wall surface 11. In addition, this shape of the pin-seal portion 16 seen as a plan view also appears in the second and the third examples.

Figure 6:
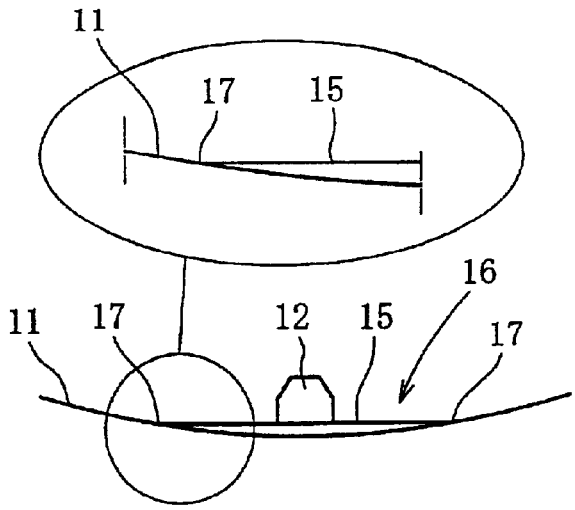
FIG. 6 is a plan view showing an inner wall surface of a skirt portion of a panel according to an embodiment of the present invention.

On the other hand, in the pin-seal portion 16 shown as the first example, as shown in a plan view in FIG. 6, the outer periphery of the flat surface 15 in the second direction continue with the inner wall surface 11 through the joint portions 17. In other words, the portion corresponding to the flat surface and the portions corresponding to the outer peripheral side extensions are formed as a uniform flat surface 15 from the joint portions 17 between the outer periphery in the second direction and the inner wall surface 11.

In addition, the constitutions of the pin-seal portions 16 shown as the first to the fifth examples are applicable to a panel whose face portion has a curved surface as well as to a so-called flat panel.

While there has been described what are at present considered to be preferred embodiments of the invention, it will be understood that various modifications may be made thereto, and it is intended that the appended claims cover all such modifications as fall within the true spirit and scope of the invention.

What is claimed is:

1. A glass panel for a color television picture tube comprising:

a substantially rectangular face portion provided with an effective screen;

a skirt portion continuing to a periphery of the face portion through a blend R portion;

a seal end surface formed on an open end of the skirt portion;

pin-seal portions for stud pins for retaining a shadow mask, formed on an inner wall surface of the skirt portion, wherein flat surfaces are formed at the pin-seal portions, each of the flat surfaces being substantially parallel with a first direction along a panel center axis and substantially parallel with a second direction along a line across two neighboring corners of the skirt portion wherein said two neighboring corners are on the inner wall surface where the flat surface located, a width of the flat surfaces in the second direction gradually increases in a direction form the face portion to the seal end surface as far as at least an end of the stud pin at the side of the face portion.

2. The glass panel for a color television picture tube according to claim 1, wherein an outer periphery of each of the flat surfaces is separated from an outer peripheral surface of the stud pin.

3. The glass panel for a color television picture tube according to claim 2, wherein the outer periphery of each of the flat surfaces is separated from the outer peripheral surface of the stud pin by 3 mm or more.

4. The glass panel for a color television picture tube according to any one of claim 1 to claim 3, wherein each of the flat surfaces has a shape satisfying a relationship of $H<L$, where H is a maximum width in the first direction of the flat surface, and L is a maximum width in the second direction of the flat surface.

5. The glass panel for a color television picture tube according to claim 4, wherein relationships $H/R>1.5$ and $L/R>3$ are satisfied, where H is the maximum width in the first direction of the flat surface, L is the maximum width in the second direction of the flat surface, and R is the diameter of the stud pin.

6. The glass panel for a color television picture tube according to anyone of claim 1 to claim 3, wherein the flat surfaces are formed when a panel glass is molded using a plunger having preformed mold surface portions corresponding to the pin-seal portions.

7. The glass panel for a color television picture tube according to claim 4 wherein the flat surfaces are formed when a panel glass is molded using a plunger having performed mold surface portions corresponding to the pin-seal portions.

8. The glass panel for a color television picture tube according to claim 1, wherein an outer periphery in the second direction of each of the flat surfaces is formed so as not to protrude toward the opposing inner wall surface of the skirt portion more than a joint portion between outer peripheral side extensions of the outer periphery and the inner wall surface of the skirt portion.

9. A glass panel for a color television picture tube comprising:

a substantially rectangular face portion provided with an effective screen;

a skirt portion continuing to a periphery of the face portion through a blend R portion;

a seal end surface formed on an open end of the skirt portion;

pin-seal portions for stud pins for retaining a shadow mask, formed on an inner wall surface of the skirt portion, wherein flat surfaces are formed at the pin-seal portions, each of the flat surfaces being substantially parallel with a first direction along a panel center axis and substantially parallel with a second direction along a line across two neighboring corners of the skirt portion wherein said two neighboring corners are on the inner wall surface where the flat surface located, and an outer periphery in the second direction of each of the flat surfaces is formed so as not to protrude toward the opposing inner wall surface of the skirt portion more than a joint portion between outer peripheral side extensions of the outer periphery and the inner wall surface of the skirt portion, and wherein the outer peripheral side extension is an inclined portion for continuing the outer periphery in the second direction and the inner wall surface of the skirt portion with each other.

10. A glass panel for a color television picture tube comprising:

a substantially rectangular face portion provided with an effective screen;

a skirt portion continuing to a periphery of the face portion through a blend R portion;

a seal end surface formed on an open end of the skirt portion;

pin-seal portions for stud pins for retaining a shadow mask, formed on an inner wall surface of the skirt portion, wherein flat surfaces are formed at the pin-seal portions, each of the flat surfaces being substantially parallel with a first direction along a panel center axis and substantially parallel with a second direction along a line across two neighboring corners of the skirt portion wherein said two neighboring corners are on the inner wall surface where the flat surface located, and an outer periphery in the second direction of each of the flat surfaces is formed so as not to protrude toward the opposing inner wall surface of the skirt portion more than a joint portion between outer peripheral side extensions of the outer periphery and the inner wall surface of the skirt portion, and wherein each of the flat surfaces is uniformly flat from the joint portion between outer peripheral side extensions of the outer periphery and the inner wall surface of the skirt portion.

* * * * *